United States Patent [19]

Scaringe et al.

[11] Patent Number: 4,856,294

[45] Date of Patent: Aug. 15, 1989

[54] MICRO-CLIMATE CONTROL VEST

[75] Inventors: Robert P. Scaringe, Rockledge; Jay A. Buckman, Melbourne; Lawrence R. Grzyll, Merritt Island, all of Fla.

[73] Assignee: Mainstream Engineering Corporation, Melbourne, Fla.

[21] Appl. No.: 152,648

[22] Filed: Feb. 4, 1988

[51] Int. Cl.[4] ..... F25D 23/12; A41D 1/04; A61F 7/00; F28F 7/00

[52] U.S. Cl. ..... 62/259.3; 2/81; 62/530; 128/402; 165/46; 165/902

[58] Field of Search ..... 2/81, 82, 69; 165/46, 165/902; 62/259.3, 293, 530; 128/402

[56] References Cited

U.S. PATENT DOCUMENTS 3,950,789 4/1976 Konz et al. ..... 2/81 X
4,400,287 8/1983 Kimura et al. ..... 165/902 X
4,540,502 9/1985 Kimura ..... 165/902 X
4,622,433 5/1987 Cahn et al. ..... 62/259.3 X
4,747,240 5/1988 Voisinet ..... 165/902 X

*Primary Examiner*—H. Hampton Hunter
*Attorney, Agent, or Firm*—Antonelli, Terry & Wands

[57] ABSTRACT

A micro-climate cooling vest of lightweight material of double wall construction, the body-proximate portion of which is comfortable and compatible with the clothing or skin of the wearer contains an internal liner portion comprised of a sealable insulative pocket that contains a heat transfer material that changes phase from solid to liquid within a practical range (e.g. 60°-90° F.) of desired body temperature cooling action, and operates to draw body heat away from the wearer in the course of its phase change form solid to liquid state. To augment the cooling action of the vest, an additional layer of ice may be used in conjunction with the primary phase change material, with the primary phase change material acting as a thermal diode.

23 Claims, 5 Drawing Sheets

MICRO-CLIMATE CONTROL VEST

FIELD OF THE INVENTION

The present invention relates in general to personal cooling systems and is particularly directed to a light-weight, body temperature control vest that is capable of keeping the wearer relatively cool under heavy work-load conditions for a period of several hours.

BACKGROUND OF THE INVENTION

Workers in high temperature environments customarily wear some form of micro-climate control system, which serves to remove metabolic heat from a person's body and thereby enables the worker to operate within the environment for reasonably lengthy periods of time (several hours). In order to not unduly limit the wearer's movement, vest-configured temperature control systems are considered to be one of the more practical approaches to sustained body control. One of the more common vest designs contains small diameter plumbing lines, embedded into the fabric of the vest, through which cold water is pumped. The body heat which is removed (transferred into the cooling water) is drawn off by a heat exchange device (usually a substantial reservoir of ice), which may be carried by the worker (e.g. by hand or via a backpack). A principal drawback to this type of cooling system is the fact that the cooling water is considerably colder (often 40° or more colder) than the desired skin temperature, which causes an undue and uncomfortable cooling of different parts of the body. To resolve this problem it becomes necessary to incorporate a control device into the cooling system, so as to shut off or vary the proportion of cooling water flow to various parts of the body. Unfortunately, this solution adds further weight, complexity and reliability problems to a system that is already burdened by a heat exchanger, pump (to circulate the water) and battery (to power the system).

Another, but less used, design employs a pressurized fluid stored in a pressure vessel, which is flashed-off to provide the requisite cooling. In addition to the weight of the pressure vessel, such a system suffers from the greater problem of environmental air contamination. Usually this type of system utilizes fluorocarbon refrigerants which are flashed and then expelled into the atmosphere where the worker is located. To obviate this problem liquid air ca be flashed off to provide both a cooling source and breathing air. However, like the configuration described supra, the system is complex, heavy and operates at temperatures well below a desired skin-surface temperature of 80°-90° F. (For an illustration of Patent literature describing personal cooling systems of the types described above, attention may be directed to the U.S. Pat. Nos. to Friedlander et al 3,643,463, Konz et al 3,950,789, Rowe 3,802,215, Gough 3,296,819, Troyer 3,610,323 and Elkins et al 4,691,762.)

SUMMARY OF THE INVENTION:

In accordance with the present invention, the shortcomings of such conventional micro-climate cooling systems are obviated by a new and improved cooling vest that is effectively self-contained, requiring no separate heat exchanger, pump, power supply and cumbersome 'plumbing', that burden the user with unwanted weight, complexity, and movement constriction. For this purpose, the present invention comprises a vest-type garment made of lightweight material (e.g. nylon cloth) having an interior cross-section of double wall construction, the body-proximate portion (the nylon cloth) of which is comfortable and compatible with the clothing or skin of the wearer and the internal portion of which is comprised of a sealable insulative pocket or liner, having a thickness on the order of 1"-2", that contains a heat exchange or thermal energy-transfer material that changes phase from solid to liquid within a practical range of desired body temperature (e.g. 60°-90° F.). The cooling action of the vest maintains a 'comfortable' skin surface temperature on the order of 90° F. and operates to draw body heat away from the wearer in the course of its phase change from solid to liquid state. An optional outer layer of insulating foam material may be provided adjacent to the inner liner. For the above temperature range preferred materials include chloroacetic acid-o-cresol eutectic, tetradecylbenzene, sodium chromate decahydrate, n-octanoic acid, chloroacetic acid-phenol eutectic, acetic acid, a salt mixture of 37% $NaSO_4$, 17% NaCl and 46% water, 1-octadecene, glycerol, n-hexadecane, polyethylene glycol 600, double clathrate of water with tetrahydrofuran and hydrogen sulfide, lithium chloride ethanolate, n-Heptadecane, copper nitrate hexahydrate, lactic acid, manganous nitrate hexahydrate, n-octadecane, methyl palmitate, 3-methylpentacosane, orthophosphoric acid hemihydrate, lithium nitrate trihydrate, calcium chloride hexhydrate, gallium and sodium sulfate decahydrate.

Thus, for example, if it is desired to achieve cooling action in the middle portion of the above range, a heat transfer material such as n-octadecane, which changes state at 82° F., may be employed. Such a material may be stored in a multi-seamed vest-shaped liner comprised of a durable, light-weight plastic, such as vinyl or polyurethane, located adjacent to the skin area-contacting nylon cloth, where body cooling is to be imparted. If the vest wearer's skin temperature is above the phase change temperature of the heat transfer material, the material will change from solid phase to liquid phase, thereby substantially increasing its thermal conductivity and thermal capacity, drawing body heat away from the wearer, so as to cool the body. If the skin cools down to a point less than the phase change temperature of the material, the material will begin to solidify and slow the body cooling action. In its solid state the material effectively acts as insulator, so as to inhibit heat transfer between the body and its surrounding environment.

To augment the cooling action of the vest, an additional layer of material (e.g. ice), that has a phase change temperature considerably less than the above-mentioned range, may be used in conjunction with the primary phase change material, with the primary phase change material acting as a thermal diode. Compared to the material that changes state within the above-mentioned operating range, water has a very high heat of fusion; however, as noted previously, its phase change from solid to liquid (32° F.) is too low for comfortable direct contact with the skin. When used in combination with one of the above-mentioned primary phase change materials, however, water (ice) serves as a thermal energy storage medium that assists the primary heat exchange material in providing the desired cooling effect.

To this end, the interior linear of the vest may include an ice packet, separate from the primary heat exchange material, sandwiched between an outer layer of expanded from insulation material and a thin (1"–2" cross-sectional thickness) region of heat exchange material adjacent to the interior cloth material of the vest that contacts the skin or clothing of the user. Because the primary heat exchange material changes state at a temperature which is within an acceptable skin 'comfort' zone, the surface of the skin of the wearer remains comfortable, while obtaining the benefit of the high heat of fusion of the augmenting ice pack. In effect, the primary heat exchange material acts as a thermal diode, changing state from solid to liquid phase and thereby drawing heat away from the surface of the skin of the vest wearer to the adjacent 'cold storage' ice pack, as necessary to supply the intended cooling function. However, should the skin temperature drop below the phase transition temperature of the primary heat exchange material, the material will solidify and thereby provide an insulating barrier between the wearer and the ice pack, thus preventing unwanted additional cooling of the skin.

Namely, in the above example, if the skin surface temperature should begin to drop below the melting point of the diode material (e.g. 82° F. for n-octadecane), then the diode material will solidify. Since the thermal conductivity of its solid phase is considerably lower than its liquid phase, its body cooling action will cease until the skin temperature again rises above the melting point of the diode material. When this happens, the primary heat exchange (diode) material will change state to the liquid phase to provide the intended cooling action by thermal energy transfer to the ice pack heat sink. Once the diode material has completely melted, any additional body heat will be transferred to the ice storage packet.

Even though contained within a thermally insulative packet, the ice can be expected to melt and will require periodic recharging. However, because the vest is self-contained and the primary heat exchange material operates in a range of desired skin temperature control, it still provides the wearer with an enhanced cooling system that is considerably improved with respect to conventional systems referenced previously.

DETAILED DESCRIPTION

Figure 1:
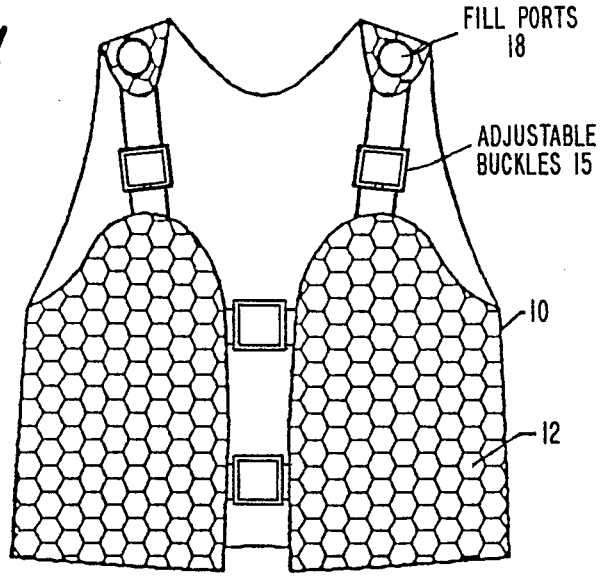
FIGS. 1 and 2 are respective front and back views of the micro-climate control vest in accordance with the present invention.
Figure 2:
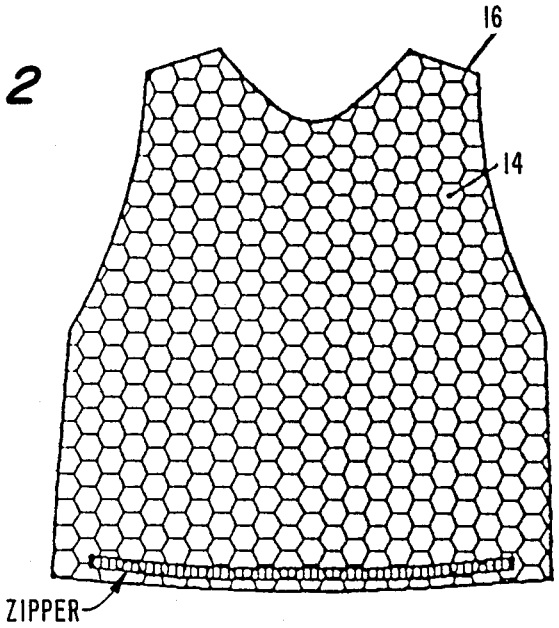

Referring now to the drawings, FIGS. 1 and 2 show a cooling garment in accordance with the present invention in the form of a vest 10 having a chest enclosing portion 12, a back portion 14 and a shoulder portion 16. Respective left shoulder and right shoulder portions of the vest may be connected with the chest portions by way of adjustable straps 13 and associated fasteners 15, such as buckles or Velcro-type attachment elements. Similar strap and fastener connections are provided for the chest enclosing portion 12, so that the vest, when worn, will be snug but comfortable. Preferably, the outer material of which the vest is comprised (including both that which is adjacent to the body of the wearer and that which is adjacent to the atmosphere) is a lightweight, durable material, such as a nylon, Vinton' or Fluorel-coated nylon or polyester silicon rubber-coated dacron or fiberglass neoprene coated nylon cloth. However, it should be understood that the material is not limited to nylon or any other specific material.

Figure 3:
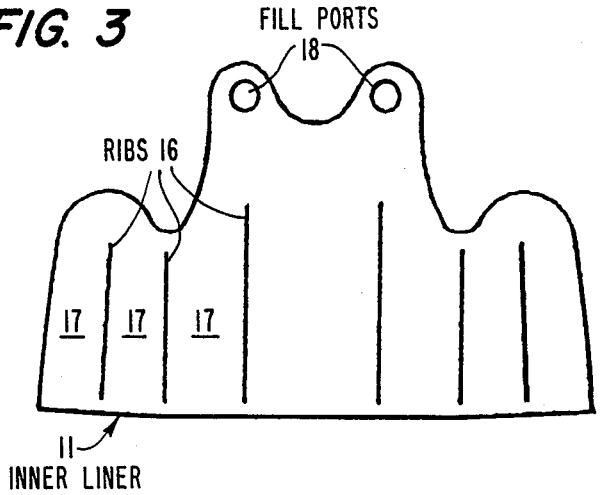
FIG. 3 diagrammatically illustrates the configuration of the inner liner employed in the vest in accordance with the present invention.

Contained within the respective chest and back portions of the vest 10 is an inner envelope or liner 11, shown in its opened configuration in FIG. 3, which is shaped or patterned in accordance with the configuration of the back and chest enclosing portions of the vest and is comprised of a material such as polyurethane or vinyl that may be filled with a heat exchange material, such as those identified in Table I below, which undergoes a phase change from solid to liquid form in a temperature range of approximately 60°–90° and thereby provides effective cooling of the surface of the skin of the wearer of the vest to a temperature on the order of 90° F.

TABLE I

| Type of Material | Phase Change Temperature |
|---|---|
| Chloroacetic acid-o-Cresol eutectic | 60.4° F. |
| Tetradecylbenzene | 60.8° F. |
| Sodium Chromate Decahydrate | 61° F. |
| n-Octanoic Acid | 61.3° F. |
| chloroacetic acid-phenol eutectic | 61.7° F. |
| Acetic Acid | 61.9° F. |
| Salt mixture of 37% $NaSO_4$, 17% NaCl, 46% $H_2O$ | 64° F. |
| 1-Octadecene | 64.2° F. |
| Glycerol | 64.4° F. |
| n-Mexadecane | 64.8° F. |
| Polyethylene Glycol 600 | 68–77° F. |
| Double Clathrate of water with Tetrahydrofuran and Hydrogen Sulfide | 70° F. |
| Lithium Chloride ethanolate | 70° F. |
| n-heptadecane | 71° F. |
| Copper Nitrate Hexahydrate | 76° F. |
| Lactic Acid | 79° F. |
| Manganous Nitriate Hexahydrate | 79° F. |
| n-Octadecane | 82° F. |
| Methyl Palmitate | 84° F. |
| 3-Methylpentacosane | 84° F. |
| Orthophosphoric Acid Hemihydrate | 85° F. |
| Lithium Nitrate Trihydrate | 86° F. |
| Calcium Chloride Hexahydrate | 86° F. |
| Gallium | 86° F. |
| Sodium Solfate Decahydrate | 90° F. |

Because the phase change material is initially in solid form when the vest is placed on the wearer, the liner is provided with a plurality of vertically extending seams 16 joining opposite sides of the line together, so as to effectively compartmentalize the liner into a plurality of adjacent packets or chambers 17 and provide fold points for the liner to permit the vest to be comfortably wrapped around the body. Access to the interior of liner 11 may be had by way of a pair of fill ports 18 located at the top shoulder portions. When emptied of phase change material, liner 11 may be inserted into or removed from the vest by way of a zipper 19 at the lower portion of the back portion 14, as shown in FIG. 2. The thickness and "coat-size" of the vest may be tailored to meet the needs of a particular wearer. For an average male worker, the volume of the inner liner may accommodate on the order of 29 pints of heat exchange material, with a liner thickness on the order of 1–2".

Figure 4:
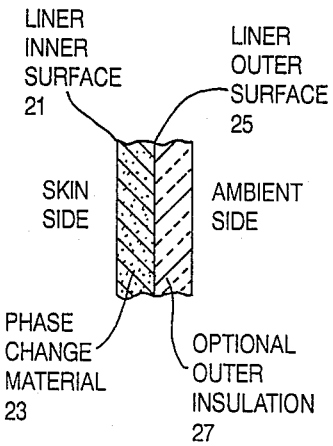
FIGS. 4 and 5 are respective cross-sectional views of the inner liner and a layer of optional insulation employed with the inner liner contained within the vest according to the present invention.

FIG. 4 shows the cross-section of the liner and a layer of optional adjacent external insulation material between the interior and exterior nylon cloth portions of the vest. Immediately adjacent to the nylon cloth on the interior, skin, or body side of the vest is the inner surface 21 of the liner 11. Between this inner surface and its outer surface 25 (the separation of which is on the order of 1–2", as noted above) is the primary heat exchange material, such as one of those listed in Table I above, which changes phase from solid to liquid within a range on the order of 60°–90° F.

The selected phase change material is introduced into the inner liner via the fill ports 18, as noted previously. Adjacent to the outer surface 25 of the liner 11, an optional layer of insulation 27, such as open-cell urethane foam or closed-cell vinyl sponge foam, may be provided. The outer layer of insulation 27, which may have a thickness on the order of ⅛" to ¾", is backed by the nylon cloth at the exterior portion of the vest.

When constructed in the manner shown in FIGS. 1–4, the vest is filled with a selected heat exchange material by way of the fill ports 18, so that the heat exchange material occupies the respective chambers 17 of the inner liner 11. The vest may then be placed in an environment having a temperature a few degrees below its phase change temperature, so as to solidify or "freeze" the primary heat exchange material within liner 11.

The vest will flex or fold about seams 16, so that it can be worn comfortably. Because the temperature of the phase change materials preferably falls in a range of 60°–90° F., the temperature of the inner portion of the nylon vest with which the skin of the wearer is in direct thermal communication is not uncomfortable (as would be the case with an ice bag, for example) and permits the wearer to comfortably benefit from the cooling action of the phase change material over a considerably extended period of time. As noted previously, depending upon the thermal environment to which the worker is exposed, by choice of the appropriate phase change material, the vest may provide cooling for a period of up to four hours (at a rate of 200 J/sec.), or a total energy storage capacity of $2.88 \times 10^6$ Joules.

During use, the initially solid state of the material within the liner of the vest absorbs body heat in changing state from solid to liquid form, and thereby provides cooling to the surface of the skin of the wearer in contact with the nylon cloth adjacent to the inner liner of the vest. As the phase change material continues to melt and absorb thermal energy from the wearer, cooling action continues. If the phase change material melts completely, it may then be recharged by removing the vest from the body of the wearer and placing the vest in a cool atmosphere (e.g. simply an air conditioned room, in some instances). The rate of recharge is essentially proportional to the difference between the temperature of the phase change material and that of its surrounding environment. Thus, placing the vest in an air conditioned room may require several hours for a recharge; however, when placed in a freezer, the vest may be recharged in less than a half-hour.

Figure 5:
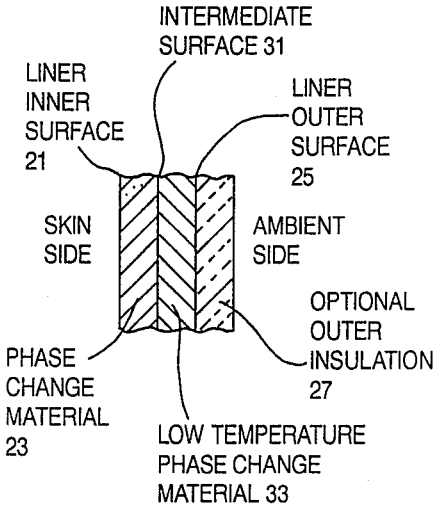

To augment the action of the phase change material, an additional low temperature (cooling) layer, having a thickness on the order of 1" or 2", may be provided in thermal communication with the primary heat exchange material. For this purpose, as shown in FIG. 5, inner liner 11 may include a further intermediate wall or surface 31 between phase change material 23 and the outer surface 25 of the liner. The basic phase change material selected from those listed in Table I is disposed in the interior chamber of the vest liner adjacent to its inner surface 21. Between the outer liner surface 25 and intermediate surface 31 an additional low temperature phase change material may be provided. As an example, a material such as ice water (supplied via separate fill ports, not shown) may be introduced into the vest, so as to provide an auxiliary heat exchange material 33 in thermal communication with the primary phase change material 23. In this embodiment, the primary heat exchange material 23 acts as a thermal diode, changing state from solid to liquid phase and thereby drawing heat away from the skin of the vest wearer to the cold storage ice or ice water pack 33, as necessary to carry out the intended cooling function. Should the skin temperature drop below the phase transition temperature of the phase change material 23, that material will solidify and thereby provide an insulating barrier between the wearer and the ice pack 33, thus preventing unwanted additional cooling of the skin.

As will be appreciated from the foregoing description, through the use of heat exchange materials that are effectively endothermic in a temperature range that is below, but comfortable with respect to, normal body temperature, the present invention overcomes the shortcomings of conventional micro-climate cooling systems by means of a new and improved cooling vest that is effectively self-contained, requiring no separate heat exchanger, pump, power supply and cumbersome 'plumbing', that burden the user with unwanted weight, complexity, and movement constriction.

While we have shown and described several embodiments in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed is:

1. A device for controlling the transfer of heat with respect to a body comprising heat exchange material that changes between solid and liquid phases at its melting/freezing temperature, and means for supporting said heat exchange material in thermal communication with the skin of the body in both its solid and liquid phases and thereby causing the temperature of said heat exchange material in each of its phases to be applied to the skin of the body, and wherein the melting/freezing temperature of said heat exchange material lies in a temperature range on the order of 60°–90° F., so as to be comfortable during prolonged thermal communication with the skin.

2. A device according to claim 1, wherein said means comprises a garment having a region containing said heat exchange material, said region being in thermal communication with the skin of the body of the wearer of the garment when said garment is placed on the body, so that the temperature of said heat exchange material is applied to the skin of the body by the wearing of said garment.

3. A device according to claim 1, wherein said heat exchange material is one which changes state between solid and liquid phases at a temperature of at least on the order of 60° F.

4. A device according to claim 2, wherein said garment further contains a region of ice disposed in thermal communication with said region of heat exchange material.

5. A device according to claim 2, wherein said garment comprises a vest having an inner chamber portion arranged to be in adjacent thermal communication with the skin of the wearer, within which inner chamber portion said region of heat exchange material is located.

6. A device according to claim 5, wherein said vest further includes an outer chamber portion arranged to be away from adjacent thermal communication with the skin of the wearer, but in thermal communication with said inner chamber portion, and within which outer chamber portion a region of heat exchange material that changes state from liquid phase to solid phase at a temperature that is different than said temperature range is located.

7. A device according to claim 6, wherein said outer chamber portion contains a region of ice.

8. A device according to claim 1, wherein said heat exchange material consists of a material selected from the group consisting of chloroacetic acid-o-cresol eutectic, tetradecylbenzene, sodium chromate decahydrate, n-octanoic acid, chloroacetic acid-phenol eutectic, acetic acid, a salt mixture of 37% $NaSO_4$, 17% NaCl and 46% water, 1-octadecene, glycerol, n-hexadecane, polyethylene glycol 600, double clathrate of water with tetrahydrofuran and hydrogen sulfide, lithium chloride ethanolate, n-Heptadecane, copper nitrate hexahydrate, lactic acid, manganous nitrate hexahydrate, n-octadecane, methyl palmitate, 3-methylpentacosane, orthophosphoric acid hemihydrate, lithium nitrate trihydrate, calcium chloride hexhydrate, gallium and sodium sulfate decahydrate.

9. A device for controlling the transfer of heat with respect to a body comprising heat exchange material that changes between solid and liquid phases at its melting/freezing temperature, and means for supporting said heat exchange material in thermal communication with the skin of the body in both its solid and liquid phases and thereby causing the temperature of said heat exchange material in each of its phases to be applied to the skin of the body, and wherein the melting/freezing temperature of said heat exchange material lies in a temperature range that is less than normal body temperature, but is capable of providing an effective, comfortably cool skin temperature on the order of 90° F. during the application of the temperature of the heat exchange material to the skin for a period of time on the order of several hours.

10. A device according to claim 9, wherein said means comprises a garment having a region containing said heat exchange material, said region being in thermal communication with the skin of the body of the wearer of the garment when said garment is placed on the body, so that the temperature of said heat exchange material is applied to the skin of the body by the wearing of said garment.

11. A device according to claim 9, wherein said heat exchange material is one which changes state between solid and liquid phases within a temperature range on the order of 60°-90° F.

12. A device according to claim 9, wherein said heat exchange material is one which changes state between solid and liquid phases at a temperature of at least on the order of 60° F.

13. A device according to claim 10, wherein said garment further contains a region of ice disposed in thermal communication with said region of heat exchange material.

14. A device according to claim 10, wherein said garment comprises a vest having an inner chamber portion arranged to be in adjacent thermal communication with the skin of the wearer, within which inner chamber portion said region of heat exchange material is located.

15. A device according to claim 14, wherein said vest further includes an outer chamber portion arranged to be away from adjacent thermal communication with the skin of the wearer, but in thermal communication with said inner chamber portion, and within which outer chamber portion a region of heat exchange material that changes state from liquid phase to solid phase at a temperature that is lower than said temperature range is located.

16. A device according to claim 15, wherein said outer chamber portion contains a region of ice.

17. A device according to claim 9, wherein said heat exchange material consists of a material selected from the group consisting of chloroacetic acid-o-cresol eutectic, tetradecylbenzene, sodium chromate decahydrate, n-octanoic acid, chloroacetic acid-phenol eutectic, acetic acid, a salt mixture of 37% $NaSo_4$, 17% NaCl and 46% water, 1-octadecene, glycerol, n-hexadecane, polyethylene glycol 600, double clathrate of water with tetrahydrofuran and hydrogen sulfide, lithium chloride ethanolate, n-Heptadecane, copper nitrate hexahydrate, lactic acid, manganous nitrate hexahydrate, n-octadecane, methyl palmitate, 3-methylpentacosane, orthophosphoric acid hemihydrate, lithium nitrate trihydrate, calcium chloride hexhydrate, gallium and sodium sulfate decahydrate.

18. A method for controlling the transfer of heat with respect to a body comprising the steps of:

(a) providing heat exchange material that changes between solid and liquid phases at its melting/-freezing temperature; and (b) placing said heat exchange material, in its solid phase, in thermal communication with the skin of the body and thereby causing the temperature of the solid phase of said heat exchange material to be applied to the skin of the body; and wherein the melting/freezing temperature of said heat exchange material lies in a range on the order of 60°-90° F., so as to be comfortable during prolonged thermal communication with the skin.

19. A method according to claim 18, wherein step (b) comprises placing a garment having a region containing said heat exchange material on said body, such that said heat exchange material contained therein is in thermal communication with the skin of the body, thereby causing the temperature of said heat exchange material to be applied to the skin of the body.

20. A method according to claim 18, wherein said heat exchange material consists of a material selected from the group consisting of chloroacetic acid-o-cresol eutectic, tetradecylbenzene, sodium chromate decahydrate, n-octanoic acid, chloroacetic acid-phenol eutectic, acetic acid, a salt mixture of 37% $NaSO_4$, 17% NaCl and 46% water, 1-octadecene, glycerol, n-hexadecane, polyethylene glycol 600, double clathrate of water with tetrahydrofuran and hydrogen sulfide, lithium chloride ethanolate, n-Heptadecane, copper nitrate hexahydrate, lactic acid, manganous nitrate hexahydrate, n-octadecane, methyl palmitate, 3-methylpentacosane, orthophosphoric acid hemihydrate, lithium nitrate trihydrate, calcium chloride hexhydrate, gallium and sodium sulfate decahydrate.

21. A method for controlling the transfer of heat with respect to a body comprising the steps of;

(a) providing heat exchange material that changes between solid and liquid phases at its melting/-freezing temperature; and (b) placing said heat exchange material, in its solid phase, in thermal communication with the skin of the body and thereby causing the temperature of said heat exchange material to be applied to the skin of the body; and wherein the melting/freezing temperature of said heat exchange material lies in a temperature range that is less than normal body temperature, but is capable of providing an effective, comfortably cool skin temperature on the order of 90° F. during the application of the temperature of the solid phase of said heat exchange material to the skin for a period of time on the order of several hours.

22. A method according to claim 21, wherein step (b) comprises placing a garment having a region containing said heat exchange material, in its solid phase, on said body, such that said solid phase heat exchange material contained therein is in thermal communication with the skin of the body, thereby causing the temperature of said heat exchange material to be applied to the skin of the body.

23. A method according to claim 21, wherein said heat exchange material consists of a material selected from the group consisting of chloroacetic acid-o-cresol eutectic, tetradecylbenzene, sodium chromate decahydrate, n-octanoic acid, chloroacetic acid-phenol eutectic, acetic acid, a salt mixture of 37% $NaSO_4$, 17% NaCl and 46% water, 1-octadecene, glycerol, n-hexadecane, polyethylene glycol 600, double clathrate of water with tetrahydrofuran and hydrogen sulfide, lithium chloride ethanolate, n-Heptadecane, copper nitrate hexahydrate, lactic acid, manganous nitrate hexahydrate, n-octadecane, methyl palmitate, 3-methylpentacosane, orthophosphoric acid hemihydrate, lithium nitrate trihydrate, calcium chloride hexhydrate, gallium and sodium sulfate decahydrate.

* * * * *

US004856294B1

REEXAMINATION CERTIFICATE (3192nd)

United States Patent [19] [11] B1 4,856,294

Scaringe et al. [45] Certificate Issued May 13, 1997

[54] MICRO-CLIMATE CONTROL VEST

[75] Inventors: Robert P. Scaringe, Rockledge; Jay A. Buckman, Melbourne; Lawrence R. Grzyll, Merritt Island, all of Fla.

[73] Assignee: Mainstream Engineering Corporation, Melbourne, Fla.

Reexamination Request:
No. 90/003,993, Oct. 6, 1995

Reexamination Certificate for:

| | |
|---|---|
| Patent No.: | **4,856,294** |
| Issued: | **Aug. 15, 1989** |
| Appl. No.: | **152,648** |
| Filed: | **Feb. 4, 1988** |

[51] Int. Cl.[6] ..... F25D 23/12; A41D 1/04; A61F 7/00; F28F 7/00

[52] U.S. Cl. ..... 62/259.3; 2/81; 62/530; 165/46; 165/902; 607/108; 607/112

[56] References Cited

U.S. PATENT DOCUMENTS

| | | |
|---|---|---|
| 2,403,676 | 7/1946 | Modlinski . |
| 3,607,591 | 9/1971 | Hansen . |
| 3,913,559 | 10/1975 | Dandliker . |
| 4,575,097 | 3/1986 | Brannigan et al. . |
| 4,756,958 | 7/1988 | Bryant et al. . |

OTHER PUBLICATIONS

SteeleVest Publication in New Equipment Digest (Aug. 1987).

SteeleVest Advertisement Leaflet, Copyright 1986.

*Primary Examiner*—William C. Doerrler

[57] ABSTRACT

A micro-climate cooling vest of lightweight material of double wall construction, the body-proximate portion of which is comfortable and compatible with the clothing or skin of the wearer contains an internal liner portion comprised of a sealable insulative pocket that contains a heat transfer material that changes phase from solid to liquid within a practical range (e.g. 60°–90° F.) of desired body temperature cooling action, and operates to draw body heat away from the wearer in the course of its phase change form solid to liquid state. To augment the cooling action of the vest, an additional layer of ice may be used in conjunction with the primary phase change material, with the primary phase change material acting as a thermal diode.

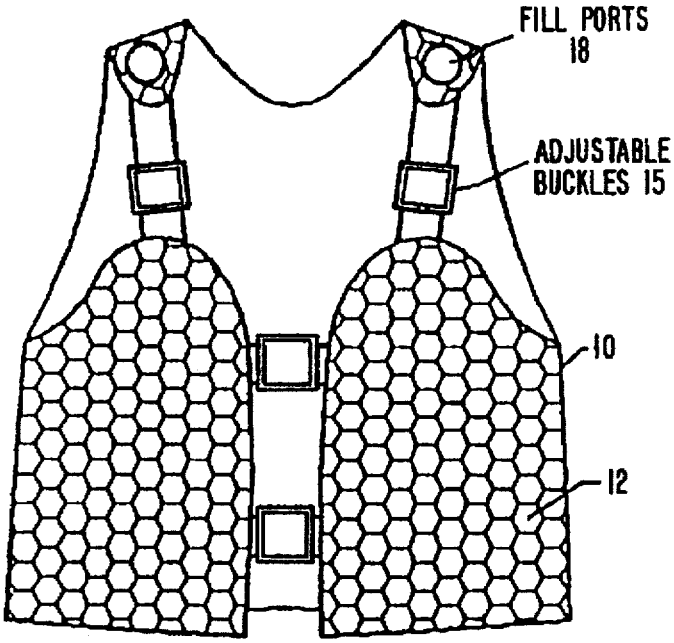

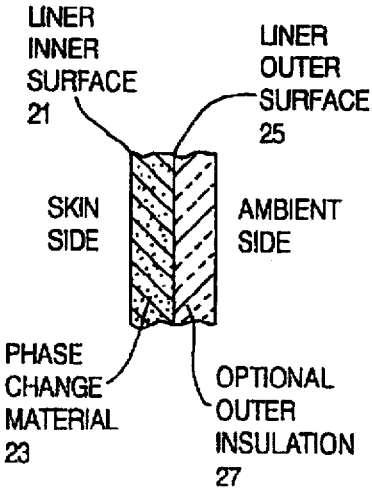

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4, 6, 7, 13 and 16 are cancelled.

Claims 1, 9, 18 and 21 are determined to be patentable as amended.

Claims 2, 3, 5, 8, 10–12, 14, 15, 17, 19, 20, 22 and 23, dependent on an amended claim, are determined to be patentable.

New claims 24–28 are added and determined to be patentable.

1. [A device] *An article worn on a living body* for controlling the transfer of heat with respect to [a] *the living* body, comprising heat exchange material that changes between solid and liquid phases at its melting/freezing temperature *solely from thermal communication with skin of the body and from ambient environment*, and means for supporting said heat exchange material in *the* thermal communication with the skin of the body in both its solid and liquid phases and thereby causing the temperature of said heat exchange material in each of its phases to be applied to the skin of the body, and wherein the melting/freezing temperature of said heat exchange material lies in a temperature range on the order of 60°–90° F., so as to be comfortable during prolonged thermal communication with the skin *at skin temperature above as well as below the melting/freezing temperature wherein the solid phase of the heat exchange material selectively permits cooling of the living body and the liquid phase selectively permits heating of the living body.*

9. [A device] *An article worn on a living body* for controlling the transfer of heat with respect to [a] *the* body, comprising heat exchange material that changes between solid and liquid phases at its melting/freezing temperature *solely from thermal communication with the skin of the body and from ambient environment*, and means for supporting said heat exchange material in thermal communication with the skin of the body in both its solid and liquid phases and thereby causing the temperature of said heat exchange material in each of its phases to be applied to the skin of the body, and wherein the melting/freezing temperature of said heat exchange material lies in a temperature range that is less than normal body temperature, but is capable of providing an effective, comfortably cool skin temperature on the order of 90° F. during the application of the temperature of the heat exchange material to the skin for a period of time on the order of several hours *at skin temperatures above as well as below the melting/freezing temperature, wherein the solid phase of the heat exchange material selectively permits cooling of the living body and the liquid phase selectively permits heating of the living body.*

18. A method for controlling [the] transfer of heat with respect to a *living* body *wearing an article*, comprising the steps of:

(a) providing heat exchange material *in the article* that changes between solid and liquid phases at its melting/freezing temperature *solely from thermal communication with skin of the body and from ambient environment*; and (b) placing said heat exchange material, in its solid phase, in *the* thermal communication with the skin of the body and thereby causing the temperature of the solid phase of said heat exchange material to be applied to the skin of the body, *which produces a liquid phase*; and wherein the melting/freezing temperature of said heat exchange material lies in a range on the order of 60°–90° F., so as to be comfortable during prolonged thermal communication with the skin *at skin temperatures above as well as below the melting/freezing temperature wherein the solid phase of the heat exchange material selectively permits cooling of the living body and the liquid phase selectively permits heating of the living body.*

21. A method for controlling the transfer of heat with respect to a *living* body comprising the steps of;

(a) providing *in an article worn on the living body* heat exchange material that changes between solid and liquid phases at its melting/freezing temperature *solely from thermal communication with the skin of the living body and from ambient temperature*; and (b) placing said heat exchange material, in its solid phase, in thermal communication with the skin of the body and thereby causing the temperature of said heat exchange material to be applied to the skin of the body *which produces a liquid phase*; and wherein the melting/freezing temperature of said heat exchange material lies in a temperature range that is less than normal body temperature, but is capable of providing an effective, comfortably cool, *substantially constant* skin temperature on the order of 90° F. during the application of the temperataure of the solid phase of said heat exchange material to the skin for a period of time on the order of several hours *at skin temperatures above as well as below the melting/freezing temperature, wherein the solid phase of the heat exchange material selectively permits cooling of the living body and the liquid phase selectively permits heating of the living body.*

*24. A device for controlling the transfer of heat with respect to a body comprising heat exchange material that changes between solid and liquid phases at its melting/freezing temperature, and means for supporting said heat exchange material in thermal communication with the skin of the body in both its solid and liquid phases and thereby causing the temperature of said heat exchange material in each of its phases to be applied to the skin of the body, and wherein the melting/freezing temperature of said heat exchange material lies in a temperature range on the order of 60°–90° F., so as to be comfortable during prolonged thermal communication with the skin, said means comprises a garment having a region containing said heat exchange material, said region being in thermal communication with the skin of the body of the wearer of the garment when said garment is placed on the body, so that the temperature of said heat exchange material is applied to the skin of the body by the wearing of said garment, and said garment further contains a region of ice disposed in thermal communication with said region of heat exchange material.*

*25. A device for controlling the transfer of heat with respect to a body comprising heat exchange material that*

*changes between solid and liquid phases at its melting/freezing temperature, and means for supporting said heat exchange material in thermal communication with the skin of the body in both its solid and liquid phases and thereby causing the temperature of said heat exchange material in each of its phases to be applied to the skin of the body, and wherein the melting/freezing temperature of said heat exchange material lies in a temperature range on the order of 60°–90° F., so as to be comfortable during prolonged thermal communication with the skin, said means comprises a garment having a region containing said heat exchange material, said region being in thermal communication with the skin of the body of the wearer of the garment when said garment is placed on the body, so that the temperature of said heat exchange material is applied to the skin of the body by the wearing of said garment, said garment comprises a vest having an inner chamber portion arranged to be in adjacent thermal communication with the skin of the wearer, within which inner chamber portion said region of heat exchange material is located, and said vest further includes an outer chamber portion arranged to be away from adjacent thermal communication with the skin of the wearer, but in thermal communication with said inner chamber portion, and within which outer chamber portion a region of heat exchange material that changes state from liquid phase to solid phase at a temperature that is different than said temperature range is located.*

*26. A device for controlling the transfer of heat with respect to a body comprising heat exchange material that changes between solid and liquid phases at its melting/freezing temperature, and means for supporting said heat exchange material in thermal communication with the skin of the body in both its solid and liquid phases and thereby causing the temperature of said heat exchange material in each of its phases to be applied to the skin of the body, and wherein the melting/freezing temperature of said heat exchange material lies in a temperature range on the order of 60°–90° F., so as to be comfortable during prolonged thermal communication with the skin, said means comprises a garment having a region containing said heat exchange material, said region being in thermal communication with the skin of the body of the wearer of the garment when said garment is placed on the body, so that the temperature of said heat exchange material is applied to the skin of the body by the wearing of said garment, said garment comprises a vest having an inner chamber portion arranged to be in adjacent thermal communication with the skin of the wearer, within which inner chamber portion said region of heat exchange material is located, said vest further includes an outer chamber portion arranged to be away from adjacent thermal communication with the skin of the wearer, but in thermal communication with said inner chamber portion, and within which outer chamber portion a region of heat exchange material that changes state from liquid phase to solid phase at a temperature that is different than said temperature range is located, and said outer chamber portion contains a region of ice.*

*27. A device for controlling the transfer of heat with respect to a body comprising heat exchange material that changes between solid and liquid phases at its melting/freezing temperature, and means for supporting said heat exchange material in thermal communication with the skin of the body in both its solid and liquid phases and thereby causing the temperature of said heat exchange material in each of its phases to be applied to the skin of the body, and wherein the melting/freezing temperature of said heat exchange material lies in a temperature range that is less than normal body temperature, but is capable of providing an effective, comfortably cool skin temperature on the order of 90° F. during the application of the temperature of the heat exchange material to the skin for a period of time on the order of several hours, said means comprises a garment having a region containing said heat exchange material, said region being in thermal communication with the skin of the body of the wearer of the garment when said garment is placed on the body, so that the temperature of said heat exchange material is applied to the skin of the body by the wearing of said garment, and said garment further contains a region of ice disposed in thermal communication with said region of heat exchange material.*

*28. A device for controlling the transfer of heat with respect to a body comprising heat exchange material that changes between solid and liquid phases at its melting/freezing temperature, and means for supporting said heat exchange material in thermal communication with the skin of the body in both its solid and liquid phases and thereby causing the temperature of said heat exchange material in each of its phases to be applied to the skin of the body, and wherein the melting/freezing temperature of said heat exchange material lies in a temperature range that is less than normal body temperature, but is capable of providing an effective, comfortably cool skin temperature on the order of 90° F. during the application of the temperature of the heat exchange material to the skin for a period of time on the order of several hours, said means comprises a garment having a region containing said heat exchange material, said region being in thermal communication with the skin of the body of the wearer of the garment when said garment is placed on the body, so that the temperature of said heat exchange material is applied to the skin of the body by the wearing of said garment, said garment comprises a vest having an inner chamber portion arranged to be in adjacent thermal communication with the skin of the wearer, within which inner chamber portion said region of heat exchange material is located, said vest further includes an outer chamber portion arranged to be away from adjacent thermal communication with the skin of the wearer, but in thermal communication with said inner chamber portion, and within which outer chamber portion a region of heat exchange material that changes state from liquid phase to solid phase at a temperature that is lower than said temperature range is located, and said outer chamber portion contains a region of ice.*

* * * * *